United States Patent [19]

Long, Jr.

[11] Patent Number: 4,949,516

[45] Date of Patent: Aug. 21, 1990

[54] CRANE TRUSS CONNECTING JOINT

[75] Inventor: Herbert D. Long, Jr., West Allis, Wis.

[73] Assignee: Harnischfeger Corporation, Brookfield, Wis.

[21] Appl. No.: 281,770

[22] Filed: Dec. 9, 1988

[51] Int. Cl.[5] ..... E04H 12/18

[52] U.S. Cl. ..... 52/645; 52/648; 403/378

[58] Field of Search ..... 52/645, 646, 648, 655, 52/633; 403/378, 379, 271, 272

[56] References Cited

U.S. PATENT DOCUMENTS 1,545,129 7/1925 Cook ..... 52/648

FOREIGN PATENT DOCUMENTS 997001 9/1951 France ..... 403/379
535669 11/1955 Italy ..... 52/633
820485 9/1959 United Kingdom ..... 52/645
847377 9/1960 United Kingdom ..... 52/655

OTHER PUBLICATIONS

Welding and Design Fabrication, Apr. 1982, pp. 72–74, article by Elmer W. Blodgett, entitled Sound Weld Details.

*Primary Examiner*—James L. Ridgill, Jr.
*Attorney, Agent, or Firm*—Richard C. Ruppin

[57] ABSTRACT

A truss connecting joint for a crane is disclosed in which the truss frame has parallel chord members each comprising two beams having I-shape cross-sections, a female ear having a pair of parallel spaced apart plates projecting from an end of one of the beams toward the other beam and a male ear including at least one plate extending from the other beam and positionable between the plates of the female ear. When the plate or plates of the male ear are positioned between the plates of the female ear, the two ears may be joined together by a member extending through the ears.

The connecting joint may be positioned between two truss lace members which are perpendicular and affixed to two parallel chord members of the truss frame. Diagonal lace members are also affixed to the truss frame adjacent to the affixation location of the perpendicular lace members to the chord members. The diagonal lace members, perpendicular lace members, and chord members are positioned such that the planes in which the centerlines of the diagonal and perpendicular lace members lie are perpendicular to a plane common to the centerlines of the chord members and the planes of the diagonal lace members intersect each other between the planes of the two perpendicular lace members.

11 Claims, 3 Drawing Sheets

CRANE TRUSS CONNECTING JOINT

FIELD OF THE INVENTION

This invention relates to a joint for connecting members of a crane truss frame and, in particular, to a splice connection which may be incorporated into a frame truss joint of a crane.

BACKGROUND OF THE INVENTION

Cranes of the larger sizes are typically too large to ship from the facility at which they are fabricated to their installation destination in one piece. They consequently are shipped in a number of disassembled separate pieces and components and assembled at their destination. In particular, gantry cranes of the portal type in which the loads lifted by the crane are moved between the legs of the crane are of a very large size and require a design which enables shipping of load bearing sections in several pieces and assembly of the load bearing sections at the operating location. The manner of assembly of the different sections together to form the finished crane must, of course, not decrease the ability of the crane to handle the large loads and duty cycle for which it is designed.

Portal cranes having overhead truss frames may have frame spans of 250 to 300 feet or more and stand on legs more than 100 feet above the ground. In view of such sizes, the legs of the crane are frequently shipped in two or three sections and the overhead frame may be shipped in three or more sections.

In assembling the various sections of the crane at the installation site, several different types of assembly or joining approaches are used. One well known assembly approach is to provide leg sections or frame sections to be joined with mating flanges which are abutted against each other and bolted together. However, such joining structures, when subjected to the alternating compression and tension stresses produced during the operation of a crane, tend to loosen and therefore require continuous maintenance. This is particularly true of such flange type joints when used in the overhead frame of a portal crane which is subject to both tension and compression as the load which it is lifting and transporting moves along the frame length. Another approach to joining the crane sections together, which produces a high-strength reliable joint, is welding of the sections together. The welded joints, however, have to be non-destructively analyzed to determine their integrity. Although a welded joint meets the reliability and strength requirements of the crane, the welding and the analysis of the welded joint are relatively costly and undesirable for that reason. A third structure used for joining crane sections together is a shear bolt joint in which a pair of facing plates, bridging the two pieces to be joined are bolted through the pieces to be joined and to each other. Although this joining approach is relatively reliable, it is extremely expensive in that a very large number of bolts is required and the labor in assembling the entire joint is substantial.

The applicant's invention is an improvement over the types of joints currently used in joining together crane sections at the site at which the crane is to be operated.

SUMMARY OF THE INVENTION

It is a general object of this invention to provide a joint for connecting together members of a crane truss frame that is of high strength and will not loosen, and that is relatively simple to accomplish. It is a further object of the invention to provide a connecting truss joint for a frame of a crane which incorporates both a truss load carrying joint and a means for connecting together the members of the frame forming the truss joint.

The invention is carried out by providing, in a truss frame utilizing parallel chord members each comprising two beams having I-shaped cross-sections, a female ear having a pair of parallel spaced apart plates projecting from an end of one of the beams toward the other beam and a male ear including at least one plate extending from the other beam and positionable between the plates of the female ear. When the plate or plates of the male ear are positioned between the plates of the female ear, the two ears may be joined together by a member extending through the female and male ears.

The connecting joint may be positioned between two truss lace members which are perpendicular to and affixed to the two parallel chord members of the truss frame. Diagonal lace members are also affixed to the truss frame adjacent to the affixation location of the perpendicular lace members to the chord members. The diagonal lace members, perpendicular lace members, and chord members are positioned such that the planes in which the centerlines of the diagonal and perpendicular lace members lie are perpendicular to a plane common to the centerlines of the chord members and the planes of the diagonal lace members intersect each other between the planes of the two perpendicular lace members.

BRIEF DESCRIPTION OF THE DRAWINGS

Further objects and advantages of the invention will appear when taken in conjunction with the accompanying drawings, in which.

DETAILED DESCRIPTION OF THE INVENTION

Figures 1, 7, 8:
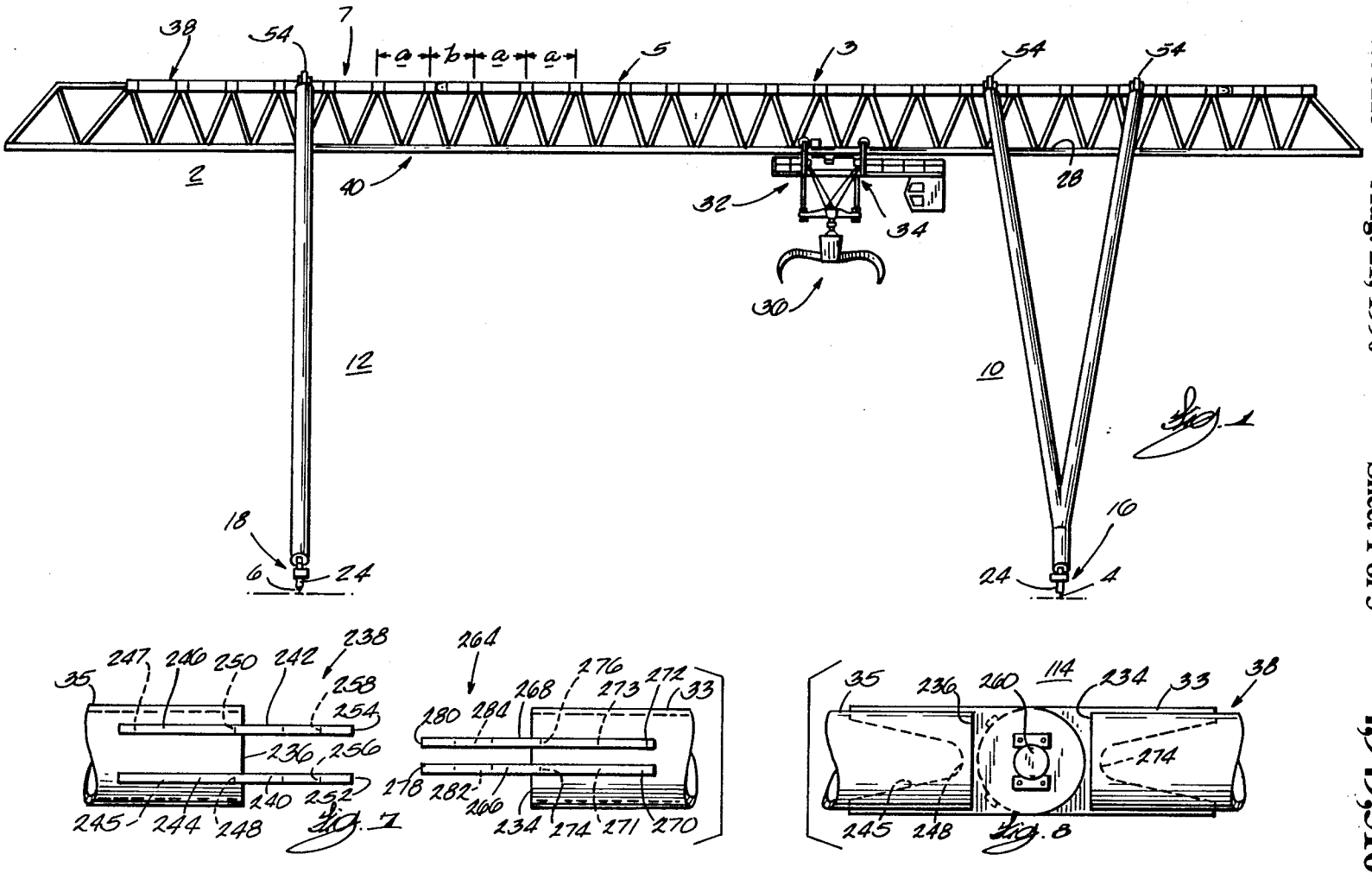
FIG. 1 is a side elevation view of a portal crane having an overhead truss type frame.
FIG. 7 is a plan view of a connecting joint according to the invention in the top chord of the frame of the crane prior to fitting of the joint members together to connect two parts of the top chord of the frame.
FIG. 8 is a side elevation view of the connecting joint in the top chord of the frame shown in FIG. 7 subsequent to the fitting of the joint members together to complete the connection in the top chord.
Figure 3:
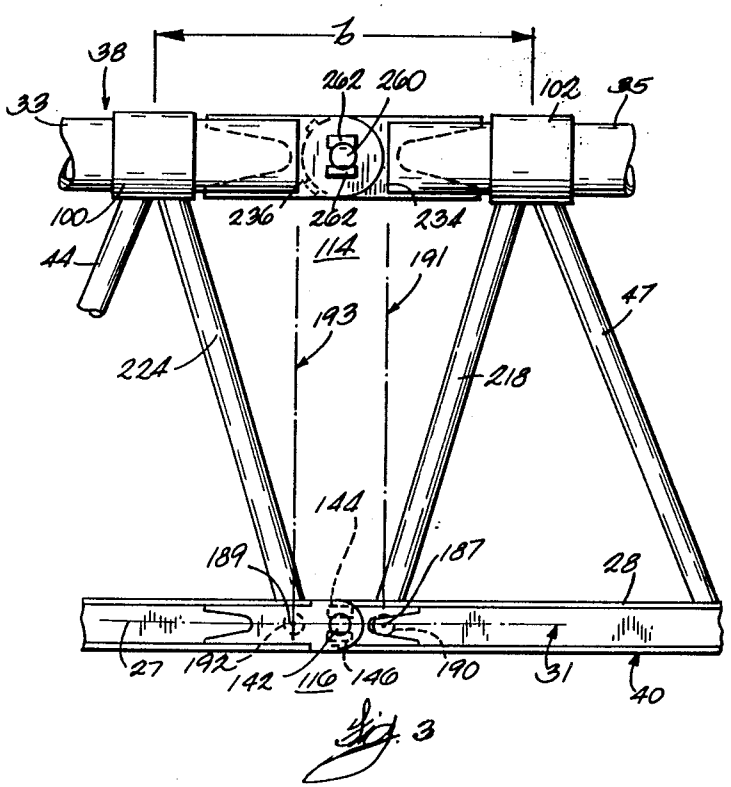
FIG. 3 is a side elevation view of a portion of the overhead frame of the crane shown in FIG. 1, illustrating the joining of two sections of the frame.
Figure 2:
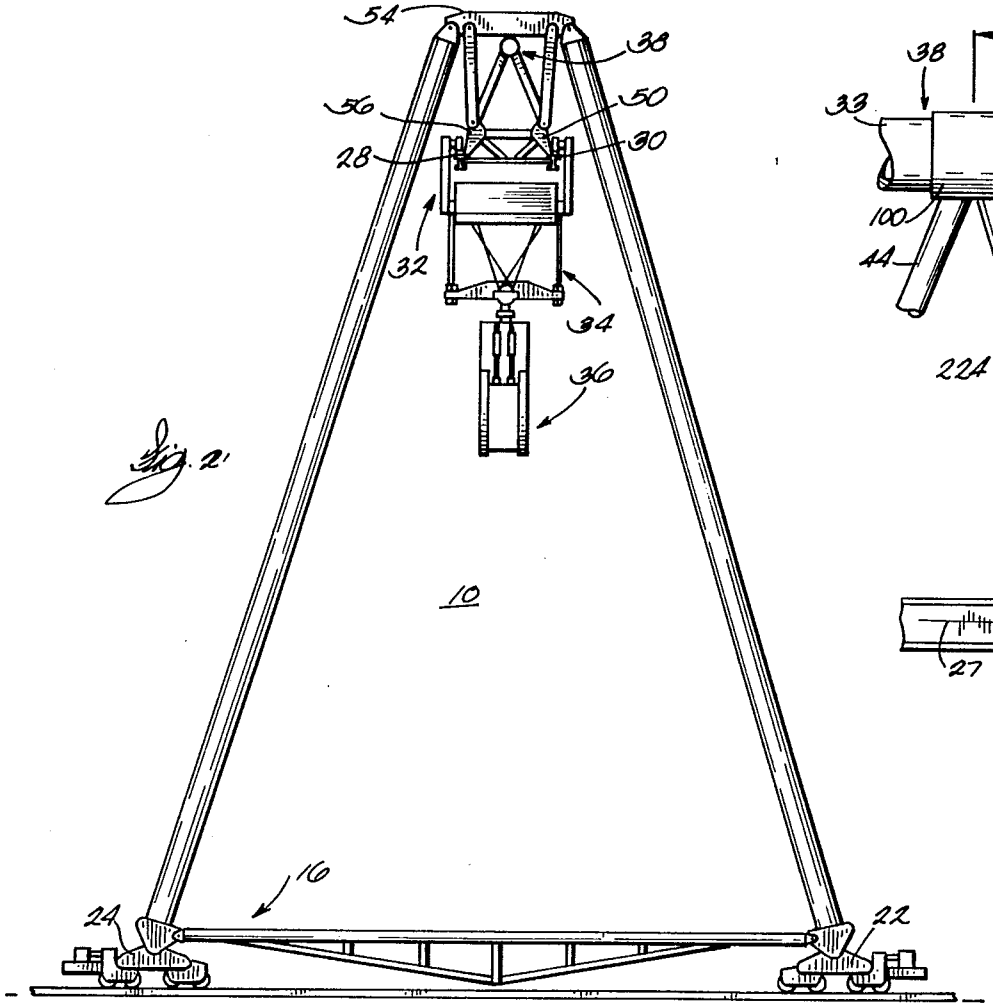
FIG. 2 is an end elevation view of the crane shown in FIG. 1.

Referring generally to FIGS. 1–3 of the drawings, a portal crane is illustrated as having a frame 2 disposed generally horizontally and overlying two generally parallel rails 4 and 6 extending through a material storage area. The crane also includes two spaced apart legs 10 and 12 affixed to the frame 2 and extending between the frame and a different one of the rails 4 and 6. The legs 10 and 12 respectively have lower base ends 16 and 18. The base ends 16 and 18 each have a pair of spaced apart wheel assemblies 22 and 24. The wheel assemblies 22 and 24 on the base end 16 engage and ride on the rail 4 and the wheel assemblies 22 and 24 engage and ride on the rail 6. The crane may thus travel along the rails 4 and 6 on the wheel assemblies 22 and 24 through the material storage area.

The frame 2 includes a pair of parallel tracks 28 and 30 from which a trolley 32 is supported for travel along the length of the frame 2. A hoist 34 is mounted on the trolley 32 and includes a grapple hook 36 for raising and lower a load of material which is to be stored in or removed from the storage area, and holding the material as the trolley 32 moves along the tracks 28 and 30, and the crane moves along the rails of 4 and 6.

The frame 2 is of a truss construction having a generally triangular cross-section. Chord members extend substantially the length of the frame 2 at the corners of the triangular cross-section and comprise a top chord member 38 and bottom chord members 40 and 42. Lace members connect between the chord members along the length of the frame 2 and will be discussed in greater detail hereafter. At each location of a leg 10 and 12, the frame 2 also includes at least one support beam 54 mounted on the top chord 38, and a pair of support plates 50 and 56 affixed to one of the bottom chords 40 or 42.

The frame 2 includes frame sections 5 and 7 each of which has a plurality of truss sections such as truss sections a of section 5 shown in FIGS. 1, 3, 4A and 4B. Each such truss section a is constructed such that it provides a load carrying ability that is equal to the other truss sections a. Each truss section a has upper truss joints 100 and 102 and lower truss joints 108 and 109. The upper truss joint 100 is formed by the juncture of top chord member 38, the upper end 104 of an upper diagonal lace 44 and the upper end 105 of an upper diagonal lace 45. The upper truss joint 102 is formed by the juncture of the top chord member 38, the upper end 106 of an upper diagonal lace 47, and the upper end 107 of an upper diagonal lace 49. The lower truss joint 108 is formed by the juncture of bottom chord member 40 and the lower ends 110 and 112 of upper diagonal laces 44 and 47 respectively. The lower truss joint 109 is formed by the juncture of bottom chord member 42 and the lower ends 111 and 113 of upper diagonal laces 45 and 49 respectively. Each truss section a also includes a perpendicular lace 46 and portions of two of the lower diagonal laces 48, 51, 53 or 55. Each perpendicular lace 46 has opposite ends 208 and 209 respectively joined to the bottom chord members 40 and 42 at joints 108 and 109. The truss sections a which are not adjacent to a connecting truss section b, have an end of lower diagonal lace 53 and lower diagonal lace 55 joined to and forming part of either joint 108 or joint 109. The truss sections a which are adjacent to a connecting truss section b, have ends of lower diagonal laces 48 and 53 or 51 and 55 joined to and forming part of either joint 109 or joint 108.

Figure 4A:
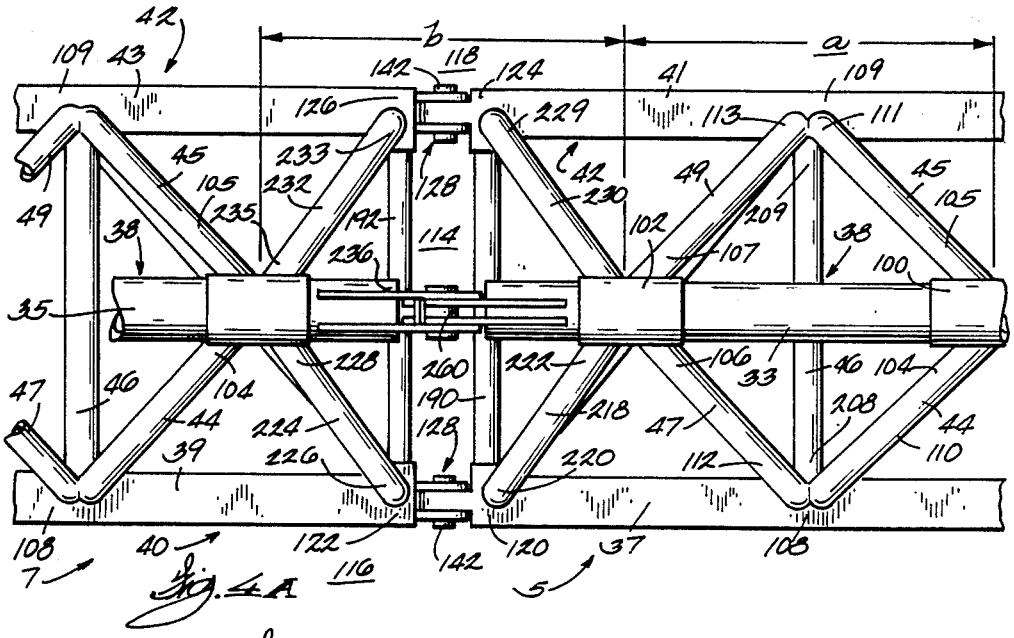
FIG. 4A is a plan view of the portion of the frame of the crane shown in FIG. 3.

With reference to FIGS. 1, 3, 4A, 4B and 5–7, a connecting truss section b connects together frame sections of the crane such as sections 5 and 7. As shown in FIGS. 3 and 4A, the top chord member 38 comprises chord beams 33 and 35, the bottom chord member 40 comprises chord beams 37 and 39 and the bottom chord member 42 comprises chord beams 41 and 43. The connecting truss section b includes an upper chord connecting joint 114 connecting chord beams 33 and 35 of top chord member 38, a lower connecting truss joint 116 136 remain flush with the upper surfaces 99 of the beams 37 and 39. The pin 142 includes a longitudinal centerline and opposite ends 143 and 145. Keeper plates 144 and 146 are mounted on the distil end 134 of female plate 130 by any suitable means and engage the pin 142 at its end 145 to retain the pin through the openings 138 and 140. The female plates 130 and 132 also include V-shape slits 152 and 154 disposed in planes parallel to the web 95 of the beam 39 and having inner ends 148 and 150 and apexes 156 and 158 extending toward the distil ends 134 and 136 of the plates 130 and 132. Due to the tapering of the V-shaped slits 152 and 154 in the female plates 130 and 132, the load on the beam 39 will be taken gradually along the length of the female plates 130 and 132 from their inner ends to the location of the apexes of the V-shaped slits. Thus the stress of the load taken by the plates 130 and 132 will be distributed such that a high level of load stress on the plates 130 and 132 at their inner ends due to the taking of the load is avoided.

Figure 4B:
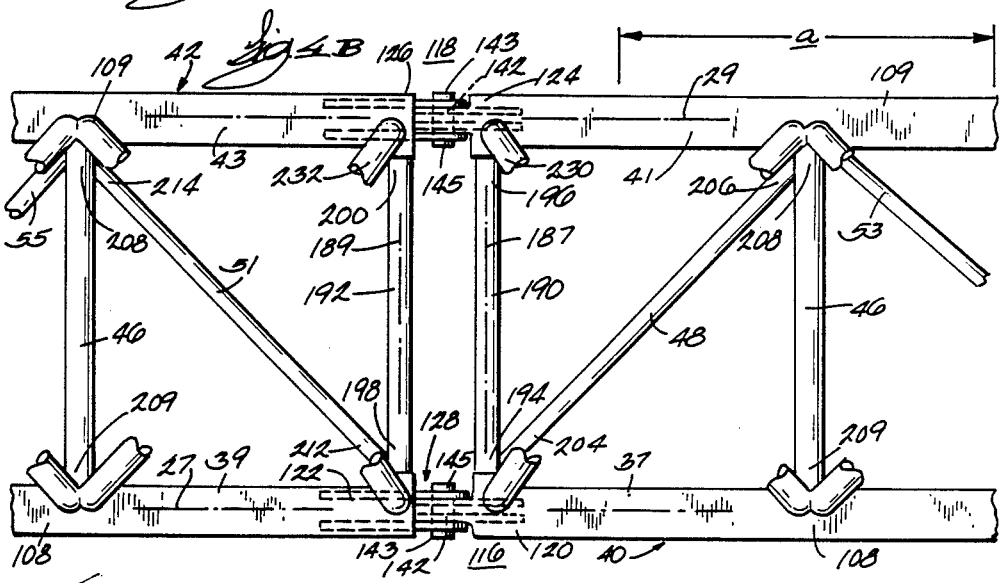
FIG. 4B is another plan view of the portion of the frame of the crane shown in FIG. 3 with some components of the frame removed for purposes of clarity.
Figure 5:
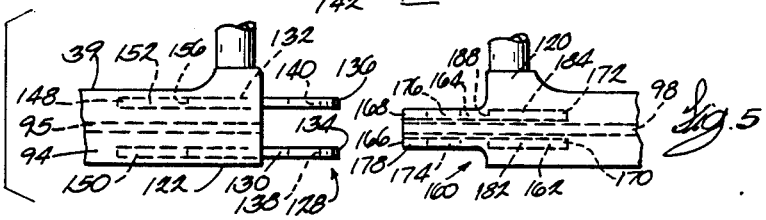
FIG. 5 is a plan view illustrating a connecting joint according to the invention prior to fitting the joint members together to connect two parts of a chord of the frame.
Figure 6:
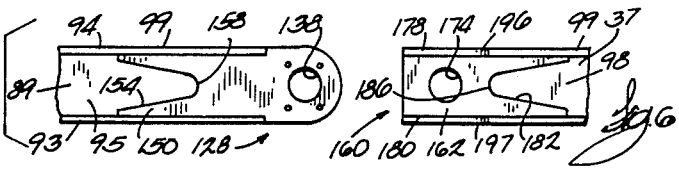
FIG. 6 is a side elevation view of the connecting joint shown in FIG. 5 prior to the fitting together of the connecting joint.
Figure 9:
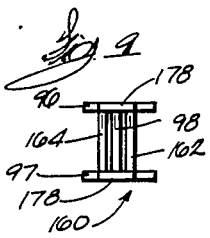
FIG. 9 is an end elevation view of one part of the connecting joint illustrated in FIGS. 5 and 6.

With reference to FIGS. 5, 6 and 9, the bottom chord connecting truss joint 116 at the end 120 of beam 37 of chord member 40 includes a male ear 160 projecting from the end 120. The ear 160 has a pair of parallel male plates 162 and 164 including outer distil ends 166 and 168 and inner ends 170 and 172 affixed to the flanges 196 and 197 of the beam 37. The male plates 162 and 164 are spaced apart from the web 98 of the beam 37 and are spaced apart from each other a distance such that the male plates 162 and 164 will fit through the opening between the female plates 130 and connecting chord beams 37 and 39 of bottom chord member 40, and a lower connecting truss joint 118 connecting chord beams 41 and 43 of bottom chord member 42. The lower connecting truss joint 116 connects the respective ends 120 and 122 of chord beams 37 and 39. The lower connecting truss joint 118 connects the respective ends 124 and 126 of chord beams 41 and 43. The lower connecting truss joint 118 is a mirror image of and functions in substantially the same manner as lower connecting truss joint 116, and the corresponding components of both joints 116 and 118 are identified by the same numerals. Consequently, only connecting truss joint 116 will be described in detail. The connecting truss joint 116 includes a female ear 128 projecting from the end 122 of the beam 39 of lower chord member 40 of frame section 7 and having a female pair of spaced apart plates 130 and 132 each affixed to the flanges 93 and 94 of the beam 39 by suitable means such as welding. As can be seen in FIG. 5, the female plates 130 and 132 are spaced apart and parallel to each other and they are also spaced apart and parallel to the web 95 of the beam 39. The distil ends 134 and 136 of the female plates 130 and 132 have openings 138 and 140 aligned in a direction transverse to the length of the chord member 40 for the reception of a connecting pin 142 and a height enlarged in a direction parallel to the web 95 of the beam 39 and transverse to the centerline axis of the pin 142. The height of the distil ends 134 and 136 of the female plates is enlarged only approximately the thickness of the upper flange 94 and lower flange 93 of the beam 39 such that the distil ends 134 and 132 and in the space defined by the plates 130 and 132. The distil ends 166 and 168 of the plates 162 and 164 also have openings 174 and 176 that may be aligned with the openings 138 and 140 in the female plates 130 and 132, as shown in FIGS. 3, 4A and 4B, through which the pin 142 projects to connect the male ear 160 to the female ear 128 and thereby connect the beams 37 and 39 of the chord member 40 together. The male ear 160 also includes a narrowed portion along which flanges 196 and 197 have respective narrow areas 178 and 180. The narrow flange areas 178 and 180 project with and are affixed to the male plates 162 and 164, and desirably extend to the outer width of the male ear 160. A box-shaped male ear 160 results from the combination of the male plates and the projection of the beam flange narrow areas to provide a connecting ear of a simple design which is particularly capable of carrying a high load. The inner ends 170 and 172 of the male plates 162 and 164 also respectively include V-shape slits 182 and 184 having apexes 186 and 188 extending toward the distil ends of the male plates. Similarly to the V-shaped inner ends 148 and 150 of the female plates, the V-shaped ends 170 and 172 of the male plates function to distribute the stress of the load taken by the male plates along their length.

The lower connecting truss joints 116 and 118 include lower diagonal joint lace members 48 and 51 and a pair of joint lace members 190 and 192 which are adjacent to the female and male ears 128 and 160 and perpendicular to the bottom chords 40 and 42. The bottom chords 40 and 42 respectively have centerlines 27 and 29 lying in a common plane 31. The perpendicular lace members 190 and 192 as shown in FIGS. 3 and 4A respectively have centerlines 187 and 189 respectively lying in parallel planes 191 and 193 which are perpendicular to the common plane 31 of the bottom chords and vertical relative to the views of FIGS. 3 and 4A. The diagonal lace members 48 and 51 each have centerlines lying in intersecting planes which are perpendicular to the common plane of the bottom chords. The perpendicular joint lace member 190 has opposite ends 194 and 196 respectively affixed to the end 120 of beam 37 of bottom chord 40 and to end 124 of beam 41 of bottom chord 42. The perpendicular joint lace member 192 has opposite ends 198 and 200 respectively affixed to the end 122 of beam 39 of bottom chord 40 and the end of 126 of beam 43 of bottom chord 43. As can be seen in FIGS. 4A and 4B, the perpendicular joint lace members 190 and 192 are spaced apart but closely adjacent to each other, and are also parallel to each other. It may be noted that the perpendicular joint lace members 190 and 192 have smaller diameters than perpendicular lace members 46 of truss sections a. This is the case since each of the lace members 190 and 192 will carry a somewhat lesser load than the lace members 46 in maintaining a force equilibrium condition of the connecting truss joints 116 and 118. The lower diagonal joint lace member 48 has opposite ends 204 and 206 respectively connected to the lower chord members 40 and 42 of the frame 2, with the end 204 most desirably affixed to the end 194 of perpendicular joint lace member 190. Similarly the lower diagonal joint lace member 51 has opposite ends 212 and 214 respectively connected to the lower chord members 40 and 42 of the frame 2, with the end 212 most desirably affixed to the end 198 of the perpendicular joint lace member 192. The planes of the lower diagonal joint lace members 48 and 51 preferably intersect between the parallel planes of the perpendicular joint lace members 190 and 192 and may also intersect at the centerline of the pin 142 intermediate the ends of the pin 142. Further, the intersecting planes of the members 48 and 51 may intersect at the centerline of a bottom chord member. As shown in FIGS. 3 and 4A, an upper diagonal joint lace member 218 has opposite ends 220 and 222 respectively connected to the end 120 of beam 37 of the bottom chord 40 and the upper truss joint 102 in top chord 38. Another upper diagonal joint lace member 224 has opposite ends 226 and 228 respectively connected to the end 122 of beam 39 of the bottom chord 40 and to an upper truss joint 100. As can be seen in FIGS. 4A and 4B, the lower end 220 of member 218 and the lower end 226 of member 224 are positioned on opposite sides of and closely adjacent to the lower connecting joint 116. Also, the upper end 222 of member 218 and the upper end 228 of member 224 are positioned on opposite sides of and spaced from the upper chord connecting joint at their point of connection respectively to the beams 37 and 39. Similarly to upper diagonal joint lace members 218 and 224, upper diagonal joint lace members 230 and 232 respectively have ends 229, 231 and 233, 235 which respectively connect the end 124 of beam 41 of the bottom chord 42 and the upper truss joint 102, and end 126 of beam 43 of the bottom chord 42 and the upper truss joint 100.

The connecting truss joints 116 and 118 provide continuity in load carrying ability in the transition from one truss frame section to another such that the entire frame 2 acts as an integral unit in supporting the load carried by the hoist as well as the load of its own weight. By combining the connecting ears 128 and 160 with truss joints to form connecting truss joints 116 and 118, the truss frame design requirements for both carrying load and connecting frame sections together can be made at the connecting truss joints.

Referring now to FIGS. 3, 4A, 7 and 8, the top chord connecting joint 114 includes an end 234 of the beam 33 of top chord 38 in frame section 5 and a facing end 236 of the beam 35 of top chord 38 in frame section 7. A female ear 238 projects from the end 236 of the beam 35 and comprises a pair of spaced apart parallel plates 240 and 242 affixed at their inner ends 244 and 246 to the beam 35 by suitable means such as welding. The ends 244 and 246 have V-shaped slits 245 and 247 having apexes 248 and 250 extending toward the distil ends 252 and 254 of the plates 240 and 242. The V-shape of the ends 244 and 246 result in the gradual transfer of the load of the beam 35 to the plates 240 and 242 so that there is a distribution of the stress due to the load transferred to the plates and high stress concentrations are avoided. The distil ends 252 and 254 of the plates 240 and 242 have aligned openings 256 and 258 for receiving a connecting pin 260. Keeper plates 262 are affixed to the plate 240 for retaining the pin 260 in the openings 256 and 258.

A male ear 264 projects from the end of the beam 33 toward the female ear 238 and includes a pair of parallel spaced apart male plates 266 and 268 having inner ends 270 and 272 affixed to the beam 33 by suitable means such as welding. The inner ends 270 and 272 have V-shaped slits 271 and 273 respectively including apexes 274 and 276 extending in the direction of the end 234 of the beam 33. The V-shaped ends 270 and 272 permit gradual transfer of load from the beam 33 to the plates 266 and 268 so that load stress is distributed and high stress concentrations on the plates 266 and 268 do not occur. The plates 266 and 268 also include distil ends 278 and 280 having aligned openings 282 and 284 through which the connecting pin 260 may be extended. The spacing distance of the two male plates 266 and 268 is such that the width of the male ear 264 is slightly less than the spacing distance between the female plates 240 and 242. Thus, the male ear 264 may be extended into the space between the female plates 240 and 242 and the openings 282 and 284 in the male plates may be aligned with the openings 256 and 258 in the female plates. The pin 260 can then be inserted through the four aligned openings 256, 258, 282 and 284 to provide the attaching connection of the top chord connecting joint 114. It may be noted that, although the chord beams 33 and 35 are of a tubular cross-section, chord beams having other cross-sections suitable for attachment to the connecting joint 114 and carrying the necessary load as part of the truss frame 2 may also be used. The top chord connecting joint 114 provides a high-strength connection and continuity in load carrying ability in the transition from one frame section to another of the frame 2. The size of the female plates 240, 242 and male plates 266, 268 and the cross-sectional area of the pin 260 can be readily varied at the time of fabrication of the connecting joint 114 to vary its strength due to modifications in the truss structure resulting from the connecting joints.

The top chord connecting joints 114 and the bottom chord connecting joints 116 and 118 are of a relatively simple construction and provide a continuity of load carrying ability through the joints between the adjacent truss sections of the frame of the crane. Incorporation of each bottom chord connecting joint as a part of a truss joint enables making all modifications required for the connecting of the bottom chord beams in a single combined connecting truss joint. Moreover, the use of a single enlarged cross-section area pin enables making the chord connection in a relatively small space so that the connection can be incorporated into a truss joint. A further important benefit of the joint connection according to the invention is the elimination of welding of chord members in the field to provide the connecting joints. This, in turn, eliminates the need to make an x-ray or other analysis of the welded joints to thereby greatly simplify the work involved in connecting the frame sections in the field.

It will be understood that the foregoing description of the present invention is for purposes of illustration only, and that the invention is susceptible of a number of modifications or changes, none of which entail any departure from the spirit and scope of the present invention, as defined in the hereto appended claims.

What is claimed is:

1. A splice joint for connecting together the ends of two beams each having a length and an I-shaped cross-section including first and second spaced apart flanges and a web integral with and positioned between the flanges, comprising:

a female ear projecting from the end of one of the beams and including a female pair of spaced apart plates each affixed to the first and second flanges of the one of the beams, the female plates being positioned parallel to each other and parallel to the web of the one beam;

a male ear projecting from an end of the other of the beams and having a width transverse to the direction of its projection, the ear including a male pair of spaced apart plates each affixed to the first and second flanges of the other of the beams, the male plates being positioned parallel to each other and parallel to the web of the other beam, the male ear also including a portion of each of the first and second flanges of the other of the beams spanning the space between and affixed to the male plates;

the spacing of the male plates, including the portions of first and second flanges, being such that the male ear is narrower in its width direction than the spacing distance between the female plates and is positionable between the female plates; and connecting means engageable with the female and male ears for connecting the two beams together.

2. The splice joint according to claim 1 wherein the female pair of spaced apart plates define an open area between plates and an entrance to the open area from first and second opposite directions transverse to the length of the beam and the male ear is positionable between the female plates by movement of the male ear in either of said directions.

3. The splice joint according to claim 1 or 2 wherein:

said portions of the first and second flanges spanning the space between the male plates extend only to the width of the male ear.

4. The splice joint according to claim 1 wherein:

each female plate and male plate has an opening aligned with the openings of the other plates when the male ear is positioned between the female plates; and the connecting means comprises a member extendible through the aligned openings to connect the beams together.

5. The splice joint according to claim 1 wherein the female pair of plates are each spaced from the web of the one beam.

6. The splice joint according to claim 1 wherein each female plate has a plate length extending in the direction of the length of said one beam and affixed along the plate length to the first and second flanges of the one of the beams and an inner end in the plate length between the first and second flanges of the one beam, the inner end having a V-shape with an apex extending in the direction of the length of and toward said end of the one beam whereby connecting stress at the joint is distributed along the length of the one beam.

7. The splice joint according to claim 1 wherein the male pair of plates each have a length and are each spaced from and positioned opposite the web of the other beam along their full lengths.

8. The splice joint according to claim 5 wherein the female pair of plates are each spaced from the web of the one beam.

9. In a truss frame having a pair of parallel spaced apart elongated chord members and a plurality of lace members connected between the chord members along the length of the frame, the combination comprising:

a connecting joint in one of said chord members;

first and second lace members perpendicular to the chord members and respectively having first ends affixed to said one of the chord members on opposite sides of and closely adjacent to said connecting joint whereby the connecting joint and the first ends of the first and second perpendicular lace members form a load carrying truss joint;

the one chord member comprises two beams having facing ends, each of the two beams having an I-shaped cross-section including first and second spaced apart flanges and a web integral with and positioned between the flanges; and the connecting joint comprises a female ear including a pair of spaced apart plates projecting from the end of one of the beams of said one chord member toward the end of the other of the beams of said one chord member between the first and second perpendicular lace members;

a male ear including a pair of spaced apart male plates each having a full length positioned on opposite sides of and spaced from the web of the other of said beams, the male plates projecting from the end of the other of the beams of said one chord member, the male ear being positioned between the pair of spaced apart plates of the female ear; and connecting means engageable with the female and male ears for connecting the two beams of said one chord member together.

10. The combination according to claim 9 wherein the female pair of plates are positioned on opposite sides of and spaced from the web of said one of the beams.

11. In a truss frame having a plurality of parallel spaced apart elongated chord members and a plurality of lace members connected between the chord members along the length of the frame, the combination comprising:

a pair of bottom chord members and an overlying top chord member;

a lower connecting joint in one of said bottom chord members;

first and second lace members perpendicular to the bottom chord members and each having a centerline in a separate vertical plane, the first and second perpendicular lace members respectively having first ends affixed to said one of the lower chord members on opposite sides of and closely adjacent to said lower connecting joint;

a single upper connecting joint in the top chord member between the planes of the perpendicular lace members; and first and second upper diagonal lace members having upper ends affixed to the top chord member on opposite sides of and spaced from the upper connecting joint and respectively having lower ends affixed to said one of the lower chord members on opposite sides of and closely adjacent to said lower connecting joint, the lower connecting joint, the first ends of the first and second perpendicular lace members and the lower ends of the first and second diagonal lace members comprising a lower load carrying truss joint in substantially vertical alignment with the upper connecting joint.

* * * * *